US006851477B2

(12) United States Patent
Hill, Jr. et al.

(10) Patent No.: US 6,851,477 B2
(45) Date of Patent: Feb. 8, 2005

(54) CURVED FLAPPER WITH ANGLE VARIANT SEAT FOR A SUBSURFACE SAFETY VALVE

(75) Inventors: Thomas G. Hill, Jr., Kingwood, TX (US); Robert A. Jancha, Humble, TX (US); Robert C. Henschel, Friendswood, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/292,898

(22) Filed: Nov. 12, 2002

(65) Prior Publication Data

US 2003/0121664 A1 Jul. 3, 2003

Related U.S. Application Data

(63) Continuation-in-part of application No. 09/998,800, filed on Nov. 1, 2001, now Pat. No. 6,666,271.

(51) Int. Cl.[7] ..... E21B 34/14; F16K 31/12

(52) U.S. Cl. ..... 166/332.8; 166/320; 166/321; 251/63.4

(58) Field of Search ..... 166/324, 332.7, 166/325, 332.8, 373, 321, 316, 319; 251/63.4, 303

(56) References Cited

U.S. PATENT DOCUMENTS

| | | | | |
|---|---|---|---|---|
| 4,531,587 A | | 7/1985 | Fineberg | 166/332 |
| 4,813,481 A | * | 3/1989 | Sproul et al. | 166/51 |
| 4,926,945 A | * | 5/1990 | Pringle et al. | 166/321 |
| 5,125,457 A | | 6/1992 | Meaders | 166/322 |
| 5,145,005 A | | 9/1992 | Dollison | |
| 5,188,182 A | * | 2/1993 | Echols et al. | 166/376 |
| 5,682,921 A | | 11/1997 | Rawson et al. | 137/527.6 |
| 5,823,265 A | * | 10/1998 | Crow et al. | 166/373 |
| 5,918,858 A | | 7/1999 | Rawson et al. | 251/359 |
| 6,079,497 A | * | 6/2000 | Johnston et al. | 166/324 |
| 6,263,910 B1 | | 7/2001 | Davis et al. | |

FOREIGN PATENT DOCUMENTS

| | | |
|---|---|---|
| GB | 2 255 363 | 11/1992 |
| GB | 2 390 107 A | 12/2003 |

OTHER PUBLICATIONS

U.K. Search Report, Application No. GB 0326414.0, dated Feb. 9, 2004.

* cited by examiner

*Primary Examiner*—Frank Tsay
(74) *Attorney, Agent, or Firm*—Moser, Patterson & Sheridan, L.L.P.

(57) ABSTRACT

A subsurface safety valve for controlling fluid flow in a well bore. In one embodiment, the subsurface safety valve includes a tubular member having a longitudinal bore extending therethrough, a curved flapper removably connected to the tubular member. The curved flapper is configured to pivot against the tubular member between an open position and a closed position. The subsurface safety valve further includes a hard seat positioned inside the tubular member, in which the hard seat defines a seating surface configured to receive a sealing surface defined on a bottom periphery portion of the curved flapper to form a sealing interface having a slope that varies along the sealing interface.

30 Claims, 9 Drawing Sheets

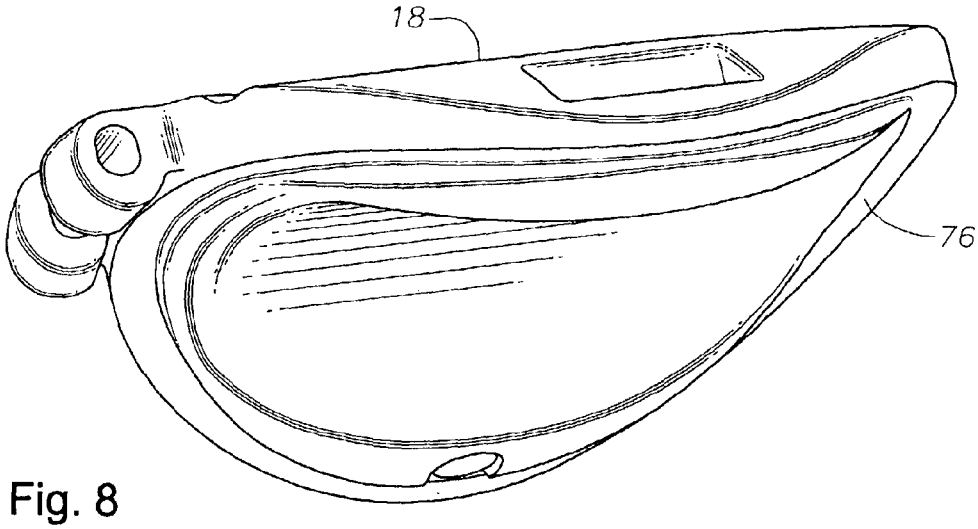
Fig. 8
Fig. 9
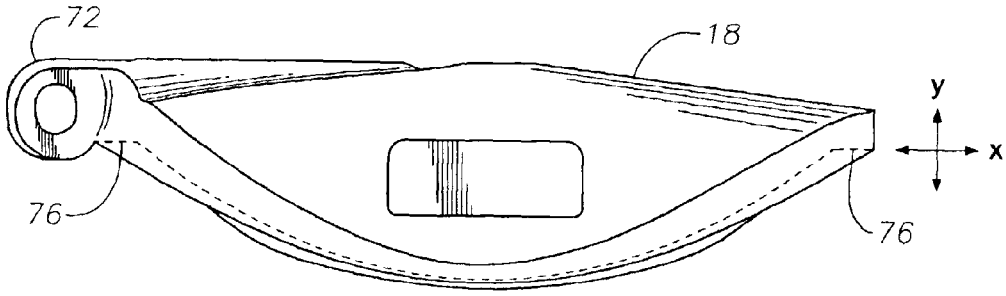

CURVED FLAPPER WITH ANGLE VARIANT SEAT FOR A SUBSURFACE SAFETY VALVE

CROSS-REFERENCE TO RELATED APPLICATIONS

This application is a continuation in part to U.S. patent application Ser. No. 09/998,800 filed on Nov. 1, 2001 now U.S. Pat. No. 6,666,271, entitled "CURVED FLAPPER AND SEAT FOR A SUBSURFACE SAFETY VALVE," which is incorporated herein by reference.

BACKGROUND OF THE INVENTION

1. Field of the Invention

This invention is generally related to safety valves. More particularly, this invention pertains to subsurface safety valves which employ a curved flapper for controlling fluid flow through a production tubing string.

2. Description of the Related Art

Surface-controlled, subsurface safety valves (SCSSVs) are commonly used to shut in oil and gas wells. Such SCSSVs are typically fitted into a production tubing in a hydrocarbon producing well, and operate to block the flow of formation fluid upwardly through the production tubing should a failure or hazardous condition occur at the well surface.

SCSSVs are typically configured as rigidly connected to the production tubing (tubing retrievable), or may be installed and retrieved by wireline, without disturbing the production tubing (wireline retrievable). During normal production, the subsurface safety valve is maintained in an open position by the application of hydraulic fluid pressure transmitted to an actuating mechanism. The hydraulic pressure is commonly supplied to the SCSSV through a control line which resides within the annulus between the production tubing and a well casing. The SCSSV provides automatic shutoff of production flow in response to one or more well safety conditions that can be sensed and/or indicated at the surface. Examples of such conditions include a fire on the platform, a high/low flow line pressure condition, a high/low flow line temperature condition, and operator override. These and other conditions produce a loss of hydraulic pressure in the control line, thereby causing the flapper to close so as to block the flow of production fluids up the tubing.

Most surface controlled subsurface safety valves are "normally closed" valves, i.e., the valves utilize a flapper type closure mechanism biased in its closed position. In many commercially available valve systems, the bias is overcome by longitudinal movement of a hydraulic actuator. In some cases the actuator of the SCSSV includes a concentric annular piston. Most commonly, the actuator includes a small diameter rod piston, located in a housing wall of the SCSSV.

During well production, the flapper is maintained in the open position by a flow tube down hole to the actuator. From a reservoir, a pump at the surface delivers regulated hydraulic fluid under pressure to the actuator through a control conduit, or control line. Hydraulic fluid is pumped into a variable volume pressure chamber (or cylinder) and acts against a seal area on the piston. The piston, in turn, acts against the flow tube to selectively open the flapper member in the valve. Any loss of hydraulic pressure in the control line causes the piston and actuated flow tube to retract, which causes the SCSSV to return to its normally closed position by a return means. The return means serves as the biasing member, and typically defines a powerful spring and/or gas charge. The flapper is then rotated about a hinge pin to the valve closed position by the return means, i.e., a torsion spring, and in response to upwardly flowing formation fluid.

In some wells, high fluid flow rates of as much as 250 million cubic feet or more per day of gas may be produced through the SCSSV. In high flow rate wells, it is well known that curved or arcuate flappers may be used to provide a larger inside diameter, or bore, in the SCSSV as compared to a flat flapper. By design, curved flapper arrangements enable a larger production tubing inner diameter, and thus, allow for a greater rate of hydrocarbon production through the valve area.

In either flat or curved flappers, as the tubular piston and operator tube retract, the flapper closure passes across the lower end of the operator tube and throttles the flow as it rotates toward the closed or "seated" position. At high flow rates, a high differential pressure may be developed across the flapper that may cause distortion and warping of the flapper as it rubs against the operator tube. Also, the flapper may be damaged if it is slammed open against the valve housing or slammed shut against the valve seat in response to the high-pressure differentials and production flow regimes. Deposition of sand particles or other debris on the valve seat and/or sealing surfaces may also cause misalignment of the flapper relative to the valve seat. Such misalignment prevents correct seating and sealing of the flapper. Consequently, a large amount of formation fluid may escape through the damaged valve, wasting valuable hydrocarbon resources, causing environmental pollution, and creating potentially hazardous conditions for well operations personnel. Furthermore, during situations involving damage to the wellhead, the well flow must be shut off completely before repairs can be made and production resumed.

Therefore, a need exists for an improved subsurface safety valve for controlling fluid flow in a well bore.

SUMMARY OF THE INVENTION

Various embodiments of the present invention are generally directed to a subsurface safety valve for controlling fluid flow in a well bore. In one embodiment, the subsurface safety valve includes a tubular member having a longitudinal bore extending therethrough, and a curved flapper removably connected to the tubular member. The curved flapper is configured to pivot against the tubular member between an open position and a closed position. The subsurface safety valve further includes a hard seat positioned inside the tubular member, in which the hard seat defines a seating surface configured to receive a sealing surface defined on a bottom periphery portion of the curved flapper to form a sealing interface having a slope that varies along the sealing interface. In this manner, the sealing interface is configured to generate reactive forces from the hard seat normal to the sealing interface, thereby preventing the curved flapper from bending toward the tubular member.

Various embodiments of the present invention are also directed to a curved flapper for a well bore safety valve. The curved flapper is configured to pivot between an open position and a closed position. The curved flapper includes a sealing surface for engaging a corresponding sealing surface on a seat disposed in the well bore safety valve to form a sealing interface having a slope that varies along the sealing interface such that reactive forces from the seat are normal to the sealing interface. The sealing interface is configured to inhibit the upward flow of fluids in a well bore when the curved flapper is in the closed position.

It will be appreciated that the flapper and seat system of the present invention are capable of performing in a sandy environment throughout any pressure range required in a hydrocarbon producing well for both tubing retrievable and wireline retrievable SCSSVs, and for both hydraulic or electrically actuated embodiments thereof.

As presented herein, embodiments of the present invention overcome deficiencies of the prior subsurface safety valves specifically by disclosing significant improvements to the flapper closure mechanism and the corresponding seat. The novel features of the invention are set forth with particularity in Detailed Description of Preferred Embodiments and The claims. The invention will best be understood from the following description when read in conjunction with the accompanying drawings.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

FIG. 8 is a close-up, bottom perspective view of the flapper in accordance with an embodiment of the invention.

FIG. 9 is a side perspective view of the flapper in accordance with an embodiment of the invention.

DETAILED DESCRIPTION OF THE PREFERRED EMBODIMENT

Figure 1:
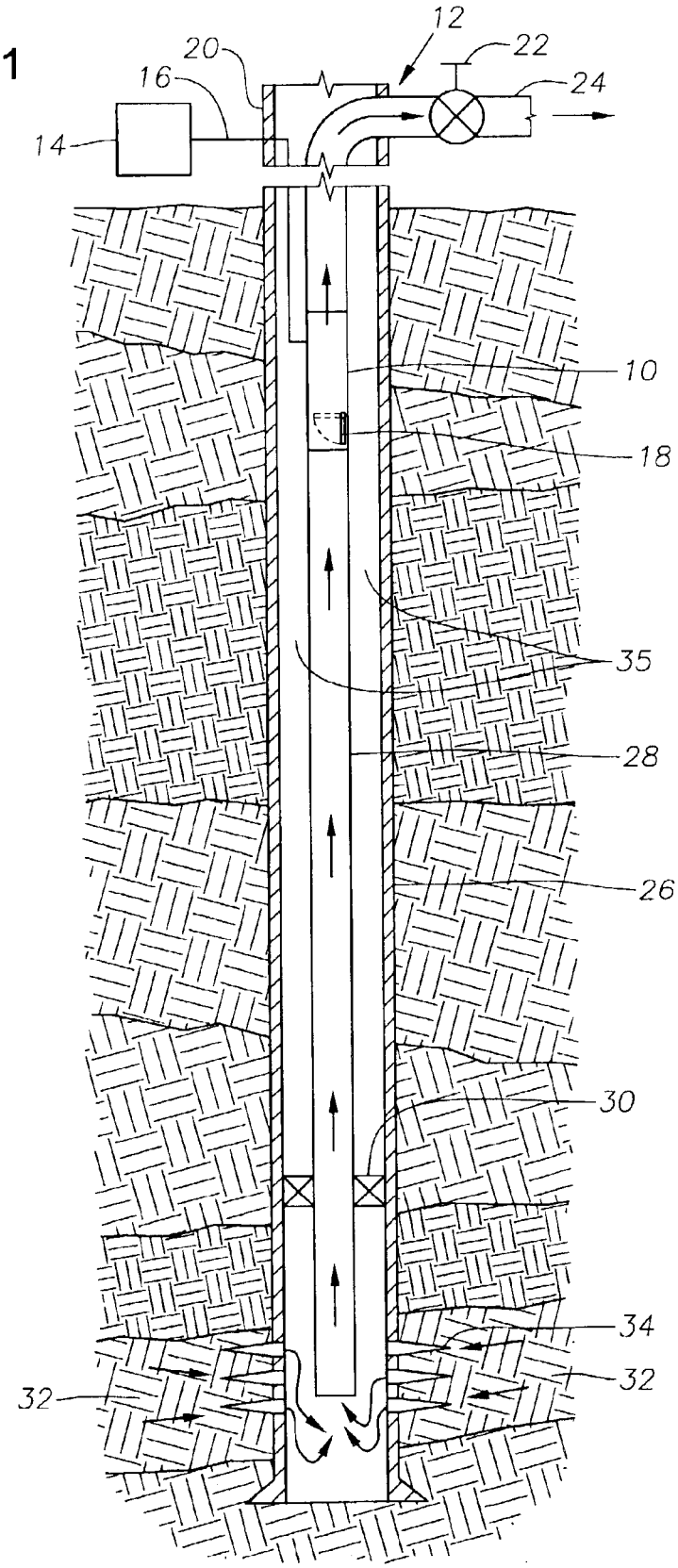
FIG. 1 is a schematic of a production well having a surface controlled, tubing retrievable subsurface safety valve installed in accordance with an embodiment of the present invention.

A detailed description will now be provided. Various terms as used herein are defined below. To the extent a term used in a claim is not defined below, it should be given the broadest definition persons in the pertinent art have given that term, as reflected in printed publications and issued patents. In the description that follows, like parts are marked throughout the specification and drawings with the same reference numerals. The drawings may be, but are not necessarily, to scale and the proportions of certain parts have been exaggerated to better illustrate details and features of the invention. One of normal skill in the art of subsurface safety valves will appreciate that the present invention can and may be used in all types of subsurface safety valves, including but not limited to tubing retrievable, wireline retrievable, injection valves, subsurface controlled valves (such as storm chokes), or any type of flapper safety valve that benefits from a larger flow area by the employment of a curved or arcuate flapper closure mechanism.

Referring now to FIG. 1, a subsurface safety valve 10 is shown in place in a typical well completion schematic 12. A land well is shown for the purpose of illustration; however, it is understood that a subsurface safety valve 10 of the present invention may be commonly used in offshore wells. Visible in the well 12 of FIG. 1 are a wellhead 20, a master valve 22, a flow line 24, a casing string 26, a production tubing 28, and a packer 30. In operation, opening the master valve 22 allows pressurized hydrocarbons residing in the producing formation 32 to flow through a set of perforations 34 and into the well 12. The packer 30 seals an annulus 35 between the casing 26 and the production tubing 28 in order to direct the flow of hydrocarbons. Hydrocarbons (illustrated by arrows) flow into the production tubing 28 through the subsurface safety valve 10, through the wellhead 20, and out into the flow line 24.

Figure 2:
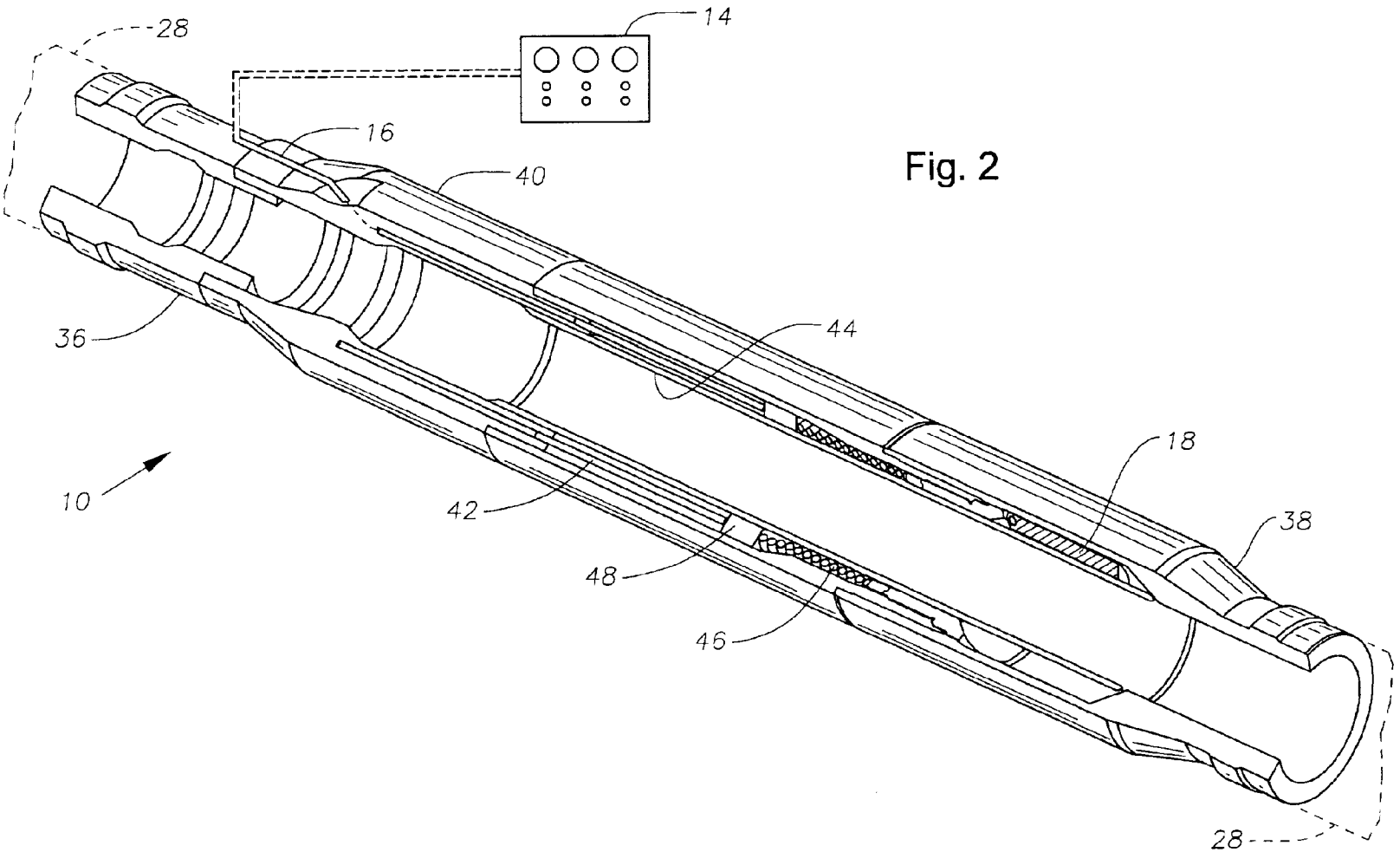
FIG. 2 is an isometric view, in partial section, of a tubing retrievable subsurface safety valve in an open position in accordance with an embodiment of the present invention.

Referring now to FIG. 2, a subsurface safety valve 10 in accordance with an embodiment of the invention is shown in an open position. An upper nipple 36 and a lower sub 38 serve to sealingly connect the safety valve 10 to the production tubing 28. The safety valve 10 is maintained in the open position by hydraulic pressure. Hydraulic pressure is supplied by a pump (not shown) in a control panel 14 through a control line 16 to the safety valve 10. The hydraulic pressure holds a flapper closure mechanism 18 within the safety valve 10 in the open position. Because the safety valve 10 is a "fail closed" device, loss of hydraulic pressure in the control line 16 will cause the flapper closure mechanism 18 to actuate, thereby blocking the upward flow of hydrocarbons to the surface.

As noted, the safety valve 10 shown in FIGS. 1 and 2 is hydraulically actuated. In this respect, the safety valve 10 includes a hydraulic chamber housing 40 and a piston 42 therein. The piston 42 is typically a small diameter piston which moves within a bore of the housing 40 in response to hydraulic pressure from the surface. Alternatively, the piston 42 may be a large concentric piston which is pressure actuated. It is within the scope of the present invention, however, to employ other less common actuators such as electric solenoid actuators, motorized gear drives and gas charged valves (not shown). Any of these known or contemplated means of actuating the subsurface safety valve 10 of the present invention may be used.

Actuating the piston 42 opens the subsurface safety valve 10. In the arrangement of the safety valve 10 shown in FIG. 2, the application of hydraulic pressure through the control line 16 serves to force the piston 42 within the chamber housing 40 downward. The piston 42, in turns, acts upon a flow tube 44, translating the flow tube 44 longitudinally. In FIG. 2, the flow tube 44 is shown shifted fully downward due to the energy from the piston 42. In this position, the flow tube 44 maintains the flapper closure mechanism 18 (obscured by flow tube 44 in this figure) in the open position.

Figure 3:
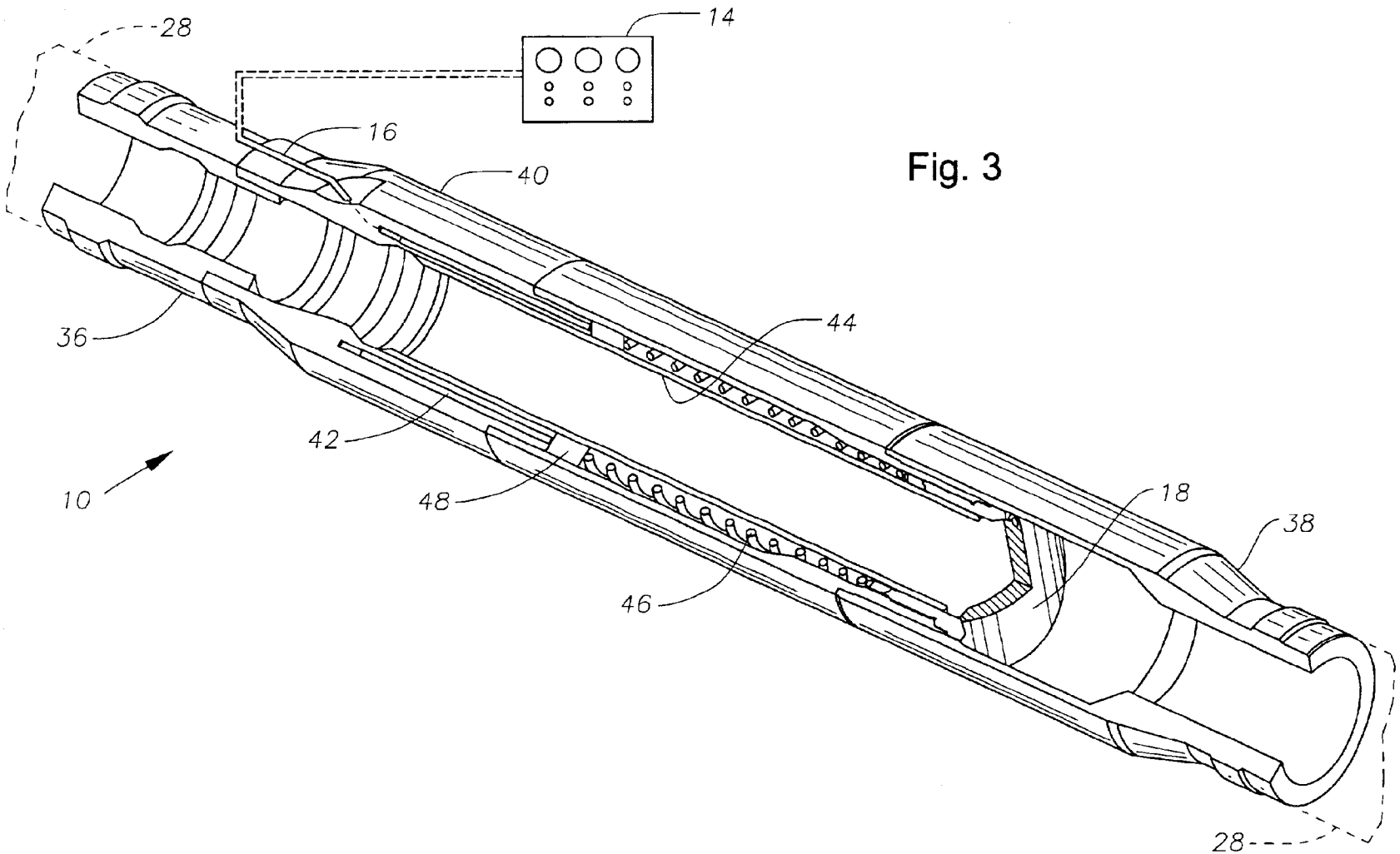
FIG. 3 is an isometric view, in partial section, of a tubing retrievable subsurface safety valve in a closed position in accordance with an embodiment of the present invention.

FIG. 3 presents the safety valve 10 of the present invention in its closed position. In this position, the flapper 18 is blocking the well bore. A power spring 46 is shown in its fully compressed position acting on a connecting means 48, allowing the power spring 46 to bias the flow tube 44 to an upward position. When pressure (or energy) is released from the piston 42 as shown in FIG. 3, the power spring 46 moves the flow tube 44 longitudinally upward, allowing the flapper closure mechanism 18 to close, and thereby preventing flow from the well.

Figure 4:
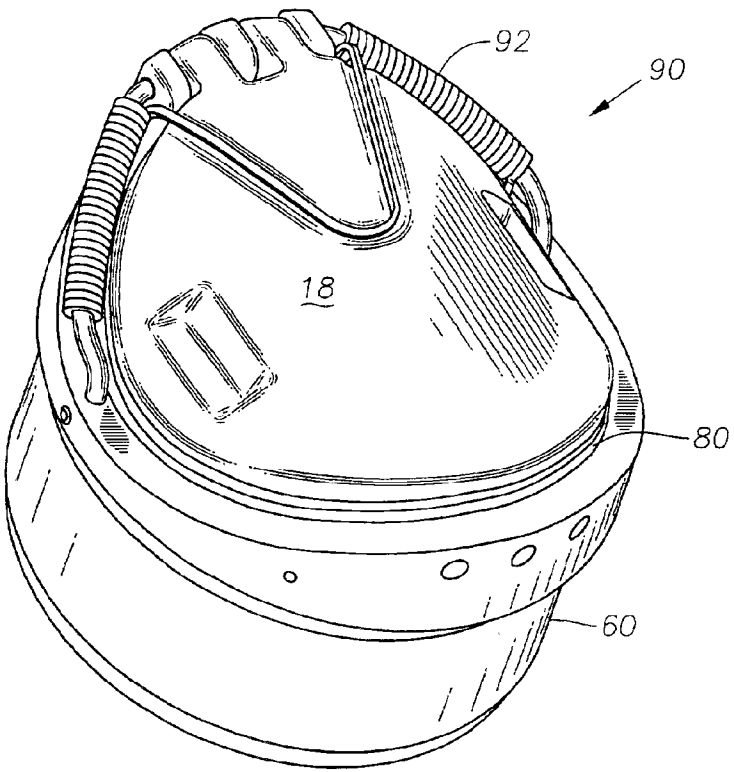
FIG. 4 is a close-up, perspective view of a flapper/seat subassembly in accordance with an embodiment of the invention.

FIG. 4 illustrates a close-up, perspective view of a flapper/seat subassembly 90 in accordance with an embodiment of the invention. The subassembly 90 includes a flapper mount 60 for mounting a hard seat (not shown) and a soft seat 80. The flapper 18 is held in a closed position by a flapper spring 92.

Figure 5:
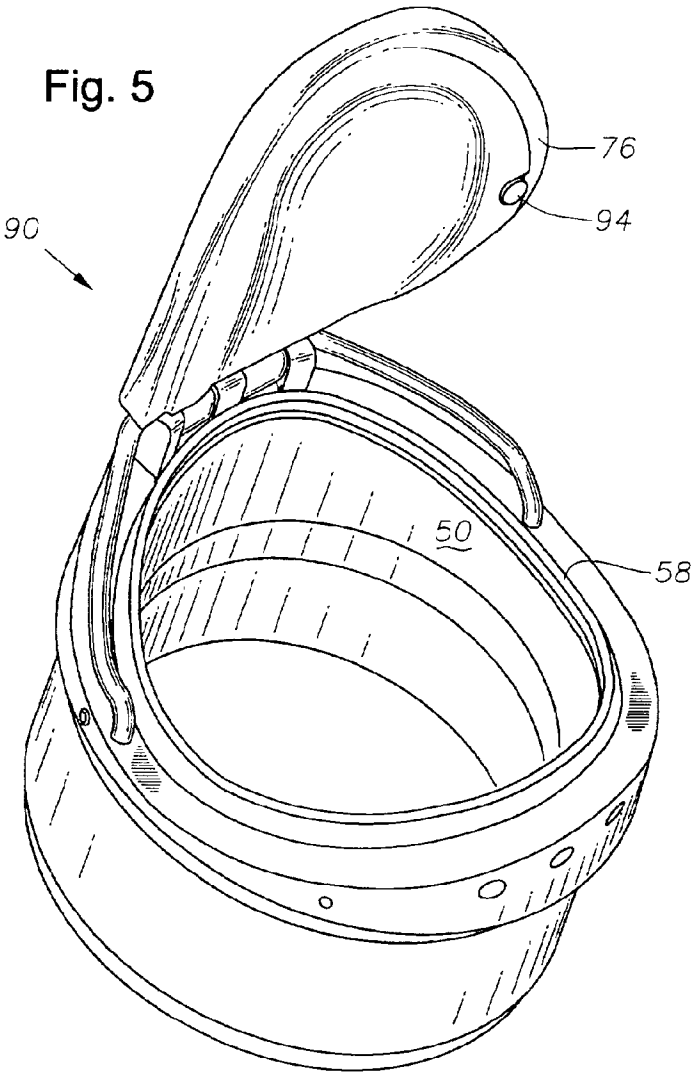
FIG. 5 is a close-up, perspective view of the flapper/seat subassembly with the flapper in the open position in accordance with an embodiment of the invention.

FIG. 5 illustrates a close-up, perspective view of the flapper/seat subassembly 90 with the flapper 18 in the open position. The flapper 18 includes a sealing surface 76 formed at the bottom periphery portion of the flapper 18. The flapper/seat subassembly 90 further includes a hard seat 50 having a seating surface 58 formed thereon. The seating surface 58 may also be referred to as a "racetrack," due to its resemblance of an automobile racetrack. The seating surface 58 is configured to provide a metal-to-metal seal with the sealing surface 76 in the closed position.

FIG. 5 further illustrates a pressure equalizing valve means 94, which may be a dart. The equalizing means 94 is configured to equalize differential pressures across the flapper 18. When the flapper 18 is closed, pressure builds up below, and acts on the flapper's surface area. This pressure force may be as high as 20,000 psig. This amount of force is too great for the flow tube 44 to overcome. Therefore, a means of equalizing pressure is required in order for the flapper 18 to open. When it becomes necessary to open the SCSSV, the flow tube 44 (not shown in this view) translates downward and contacts the equalizing means 94. The equalizing means 94 includes an opening which permits fluid to bleed through the valve 10, thereby equalizing pressure above and below the flapper 18. When pressure substantially equalizes across the flapper 18, the flow tube 44 translates axially downward and fully opens the SCSSV.

Figure 6:
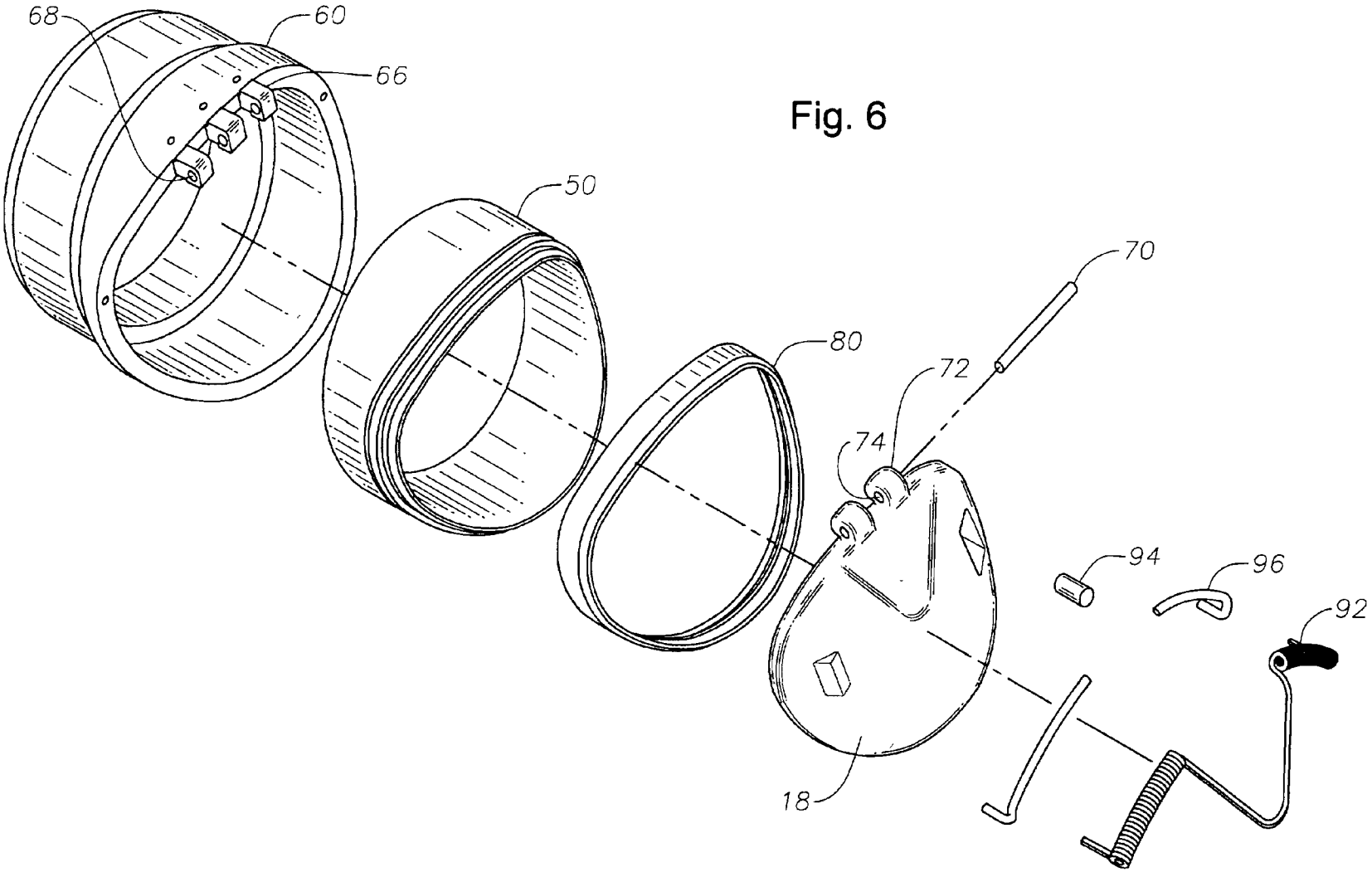
FIG. 6 illustrates an exploded isometric view of the flapper/seat subassembly in accordance with an embodiment of the invention.

FIG. 6 illustrates an exploded isometric view of the flapper/seat subassembly 90, which includes the flapper mount 60, the hard seat 50, the soft seat 80, the flapper 18, the equalizing means 94, a torsion spring pin 96, and the flapper spring 92. The hard seat 50 is configured to be positioned inside the flapper mount 60, while the soft seat 80 is configured to be concentrically positioned outside the top portion of the hard seat 50. A clevis pair 66 is fashioned into the flapper mount 60, wherein a mounting hole 68 is drilled through for receiving at least one flapper pin 70. The curved flapper 18 is rotatably mounted on the at least one flapper pin 70 by a hinge 72 having a pin hole 74 drilled therethrough. This arrangement enables the flapper 18 to pivot between its open and closed positions about the flapper pin 70. The torsion spring pin 96 is configured to hold the flapper spring 92. The flapper spring 92 is configured to bias the flapper 18 to the closed position.

In operation, the curved flapper 18 swings in an arc of substantially 80–90 degrees between its opened and closed positions about the pin 70. In its open position, the flapper 18 is positioned essentially vertically so as not to obstruct the upward flow of hydrocarbons from the well. In its closed position, the flapper 18 seals essentially horizontally within the well so as to obstruct the upward flow of fluids. In its closed position, the flapper 18 is pressed against the soft seat 80 and the seating surface 58 formed on the top surface of the hard seat 50 to form a sealing interface 100 (shown in FIG. 13).

Figure 7A:
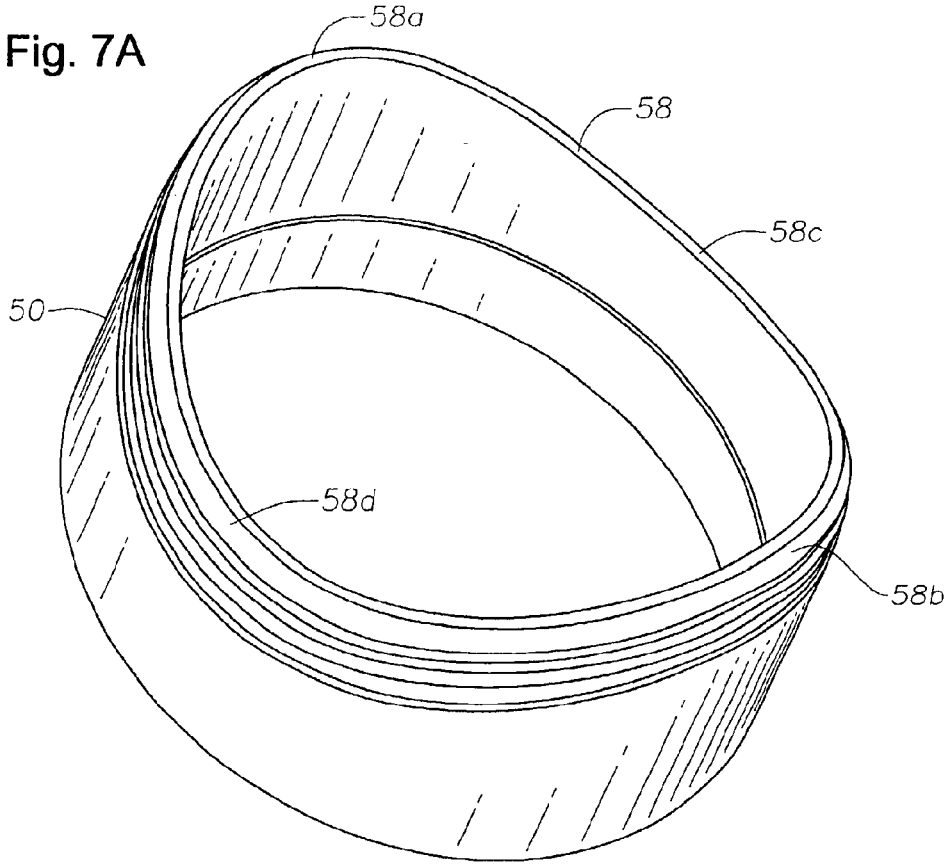
FIG. 7A is a close-up, top perspective view of the hard seat in accordance with an embodiment of the invention.
Figure 7B:
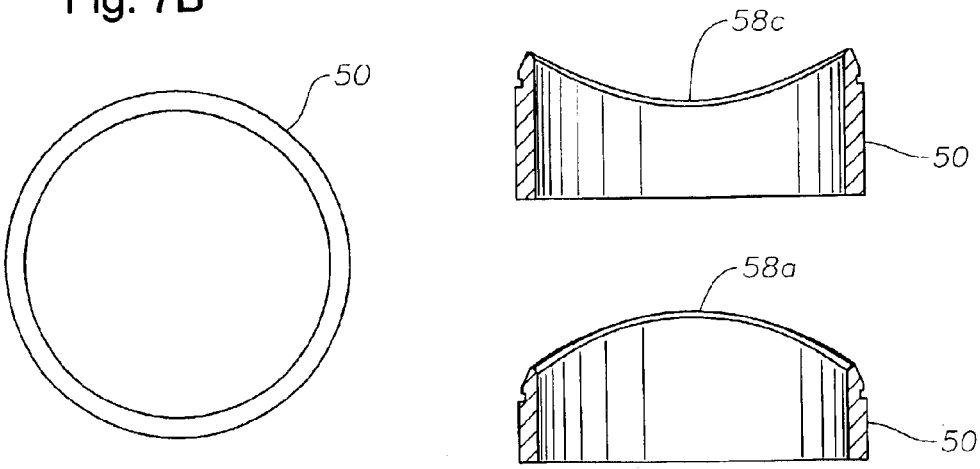
FIG. 7B is a cross sectional view of the hard seat in accordance with an embodiment of the invention.

FIG. 7A illustrates a close-up, top perspective view of the hard seat 50, which illustrates the seating surface 58 more clearly. As shown in the figure, the seating surface 58 resembles an automobile racetrack that is undulated with two raised portions (58*a*, 58*b*) and two lower portions (58*c*, 58*d*). In one embodiment, one of the raised portions (58*a*, 58*b*) is positioned near the flapper hinge 72, while the lower portions (58*c*, 58*d*) are positioned about 90 degrees from the raised portions (58*a*, 58*b*). However, the raised portions (58*a*, 58*b*) and the lower portions (58*c*, 58*d*) may be positioned anywhere along the periphery of the seating surface 58. The seating surface 58 also defines a slope or a cross sectional angle that varies along the seating surface 58. In one embodiment, the slope on the raised portions (58*a*, 58*b*) is about 0 degree with respect to an x-axis, while the slope on the lower portions (58*c*, 58*d*) is about 10–15 degrees with respect to the x-axis. In this manner, the slope varies from about 0 degree at or near the raised portions (58*a*, 58*b*) to about 10–15 degrees at or near the lower portions (58*c*, 58*d*). The slope of the seating surface 58 is more clearly illustrated in FIGS. 10 and 12. The slope is configured so that pressure that pushes against the flapper/seat subassembly 90 is normal to the seating surface 58. The extent of the slope may be determined by a finite element analysis, i.e., A=10–25 sin B, where A is the angle of the slope with respect to the x-axis and B is the angle of rotation around the hard seat 50, as shown in FIG. 7B. The angles discussed herein are merely examples and are not intended to restrict embodiments of the invention to only use those angles.

Figure 10:
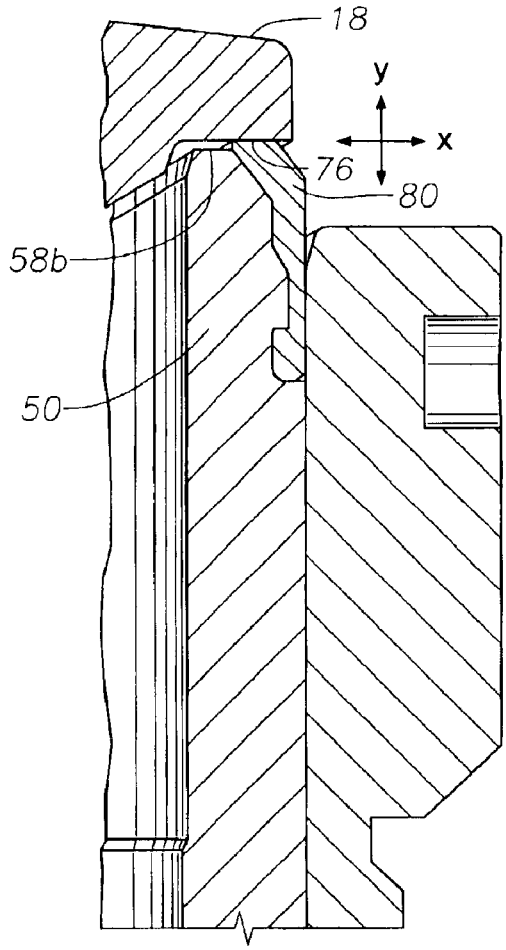
FIG. 10 is a close-up detailed isometric view, in partial section, of the flapper/seat subassembly in accordance with an embodiment of the invention.
Figure 11:
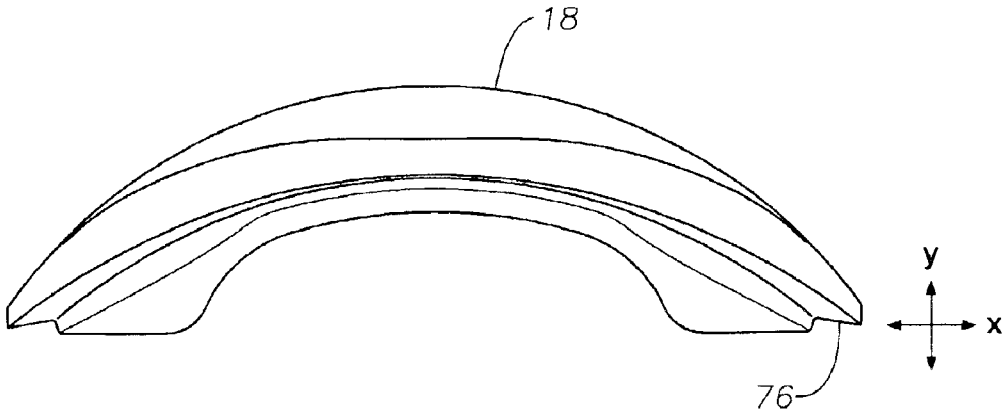
FIG. 11 is a side perspective view of the flapper in accordance with an embodiment of the invention.
Figure 12:
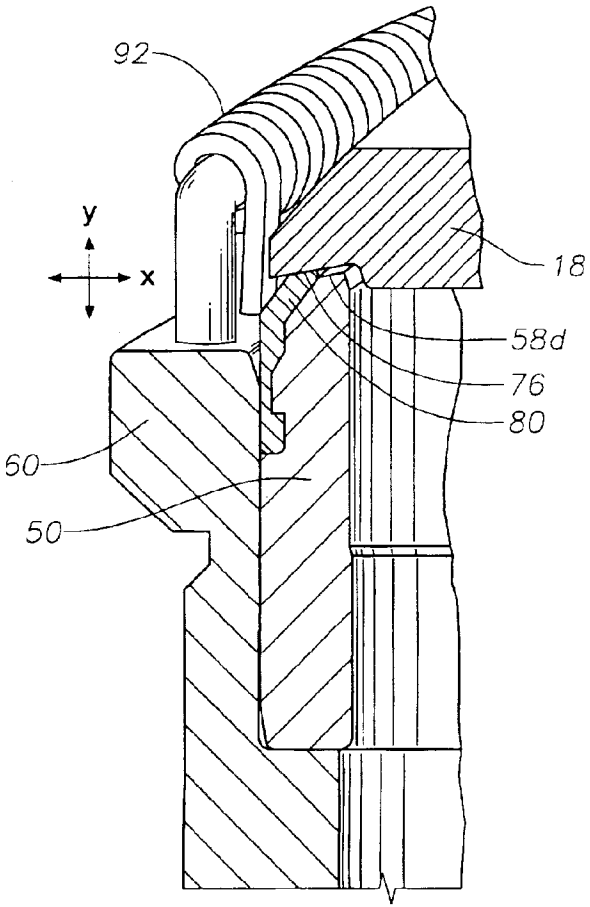
FIG. 12 is a close-up detailed isometric view, in partial section, of the flapper/seat subassembly in accordance with an embodiment of the invention.

FIG. 8 illustrates a close-up, bottom perspective view of the flapper 18, which illustrates a sealing surface 76. The sealing surface 76 is also undulated to match the seating surface 58 in the closed position, in which the sealing surface 76 is pressed against the seating surface 58. The interaction between the seating surface 58 and the sealing surface 76 forms the metal-to-metal seal, i.e., at the sealing interface 100. The seating surface 58, if unfolded in a two dimensional plane, defines a substantially sinusoidal pattern. Likewise, the sealing surface 76, if unfolded in a two dimensional plane, defines a substantially sinusoidal pattern. Thus, the sealing interface 100 defined by the interaction between the seating surface 58 and the sealing surface 76 also defines a substantially sinusoidal pattern if unfolded in a two dimensional plane. Moreover, the sealing surface 76 is designed such that the portions of the sealing surface 76 that are configured to mate with the raised portions (58*a*, 58*b*) of the seating surface 58 have a cross sectional angle or a slope of about 0 degree with respect to the x-axis, as shown in FIGS. 9 and 10. On the other hand, the portions of the sealing surface 76 that are configured to mate with the lower portions (58*c*, 58*d*) have a cross sectional downward angle or a slope of about 10–15 degrees with respect to the x-axis, as shown in FIGS. 11 and 12. Like the slope of the seating surface 58, the slope of the sealing surface 76 also varies along the sealing surface 76 from about 0 degree to about 10–15 degrees. The angles discussed herein are merely examples and are not intended to restrict embodiments of the invention to only use those angles.

FIG. 10 is a close-up detailed isometric view, in partial section, of the flapper 18, the hard seat 50, and the soft seat 80 in accordance with an embodiment of the invention. In this view, the valve 10 is shown in the closed position. The soft seat 80 is configured to protrude above the hard seat 50. As the flapper 18 closes, the soft seat 50 initially engages the flapper 18 to provide a low-pressure seal. As pressure increases, the flapper 18 moves to contact the hard seat 50, thereby providing the valve with a high-pressure seal.

The interaction between the flapper sealing surface 76 and the soft seat 80 allows for an effective seal at low pressures. The soft seal 80 is fabricated from a resilient material. The soft seat 80 may be constructed from an elastomeric material having a durometer hardness in the range of about 60 to about 99. Other materials, however, may be used for the soft seat 80. Acceptable examples include a thermoplastic polymeric material (e.g., tetrafluoroethylene (TFE) fluorocarbon polymer or polyetheretherkeytone (PEEK)), a reinforced thermoplastic containing carbon or glass, or a soft metallic material (e.g., lead, copper, zinc, gold or brass).

Figure 13:
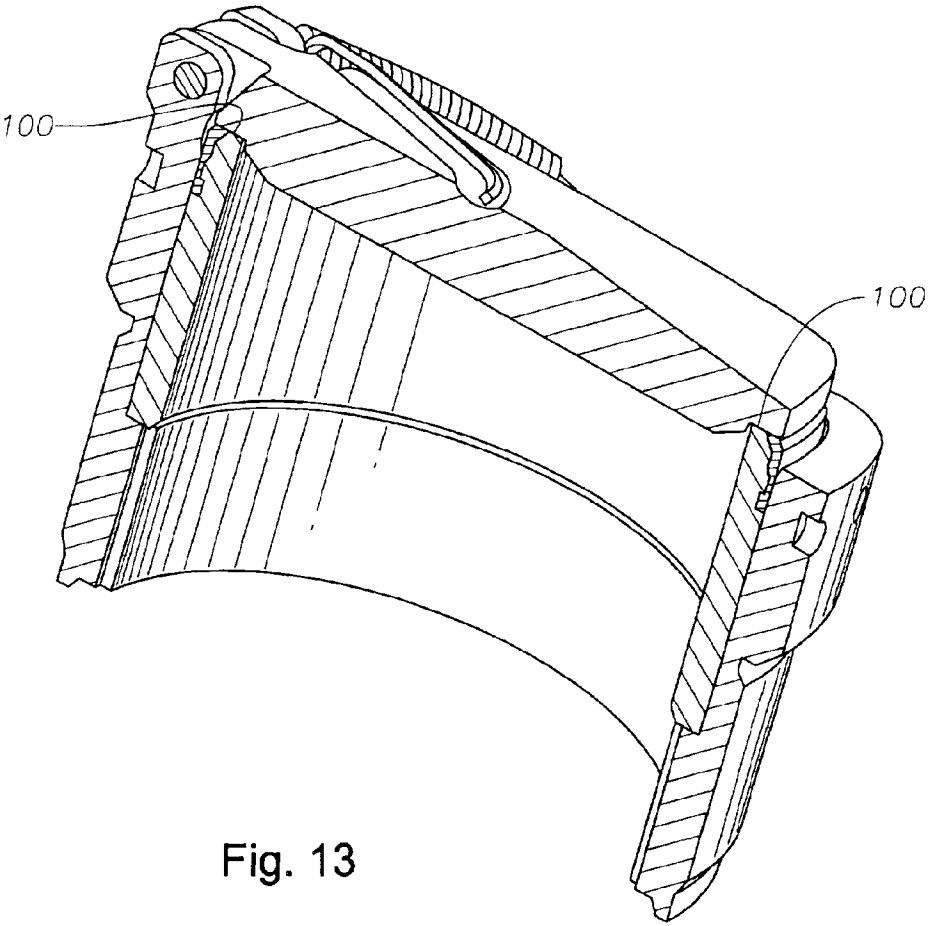
FIG. 13 is a side perspective view, in cross section, of the flapper/seat subassembly in accordance with an embodiment of the invention.

At higher pressures, the resilient nature of the soft seat material typically deforms, allowing the flapper sealing surface 76 to engage the seating surface 58 to form the sealing interface 100 (shown in FIG. 13). This interaction creates a high-pressured seal at the sealing interface 100. Embodiments of the present invention are configured to resolve forces from the high pressure applied against the flapper 18, particularly along the sinusoidal sealing surface. The reactive forces from the hard seat normal to the sinusoidal sealing surface inhibit and virtually eliminate the metaphorically descriptive "Taco Effect", or tendency of prior art curved flappers to bend toward the flapper mount 60 (like the familiar food item) when subjected to high pressure. Any such bending in a flapper can cause undesirable leakage and possible failure.

It should be noted that while a tubing retrievable embodiment is shown and discussed herein, the curved flapper and seat of the present invention might also be adapted for use in a wireline retrievable subsurface safety valve. Operation of the tubing retrievable subsurface safety valve 10 is otherwise in accord with the operation of any surface controllable, wireline retrievable safety valves that employ this invention.

Although the invention has been described in part by making detailed reference to specific embodiments, such detail is intended to be and will be understood to be instructional rather than restrictive. As has been described in detail above, the present invention has been contemplated to overcome the deficiencies of the prior equalizing safety valves specifically by improving the sealing capabilities of curved flapper subsurface safety valves.

Whereas the present invention has been described in relation to the drawings attached hereto, it should be understood that other and further modifications, apart from those shown or suggested herein, might be made within the scope and spirit of the present invention.

What is claimed is:

1. A subsurface safety valve for controlling fluid flow in a well bore, comprising:

a tubular member having a longitudinal bore extending therethrough;

a curved flapper removably connected to the tubular member, wherein the curved flapper is configured to pivot against the tubular member between an open position and a closed position; and a hard seat positioned inside the tubular member, wherein the hard seat defines a seating surface configured to receive a sealing surface defined on a bottom periphery portion of the curved flapper to form a sealing interface having a slope that varies along the sealing interface to substantially inhibit distortion between the curved flapper and the tubular member.

2. The subsurface safety valve of claim 1, wherein the slope of the sealing interface is configured to generate reactive forces from the hard seat normal to the sealing interface.

3. The subsurface safety valve of claim 1, wherein the sealing interface is configured to substantially prevent the curved flapper from bending toward the tubular member.

4. The subsurface safety valve of claim 1, wherein the sealing interface is undulated.

5. The subsurface safety valve of claim 1, wherein the sealing interface is undulated and defines at least two raised portions and at least two lower portions, and wherein the slope of the sealing interface near the at least two raised portions is about zero degree with respect to an x-axis.

6. The subsurface safety valve of claim 5, wherein the raised portions and the lower portions are about 90 degrees apart.

7. The subsurface safety valve of claim 5, wherein the slope of the sealing interface is configured to generate reactive forces from the hard seat normal to the sealing interface.

8. The subsurface safety valve of claim 1, wherein the sealing interface is undulated and defines at least two raised portions and at least two lower portions, and wherein the slope of the sealing interface is between about −10 degrees to about −15 degrees with respect to an x-axis near the at least two lower portions.

9. The subsurface safety valve of claim 8, wherein the raised portions and the lower portions are about 90 degrees apart.

10. The subsurface safety valve of claim 8, wherein the slope of the sealing interface is configured to generate reactive forces from the hard seat normal to the sealing interface.

11. The subsurface safety valve of claim 1, wherein the sealing interface is undulated and defines at least two raised portions and at least two lower portions, wherein the slope of the sealing interface is about zero degrees with respect to an x-axis near the at least two raised portions, and wherein the slope of the sealing interface is between about −10 degrees to about −15 degrees with respect to the x-axis near the at least two lower portions.

12. The subsurface safety valve of claim 11, wherein the raised portions and the lower portions are about 90 degrees apart.

13. The subsurface safety valve of claim 11, wherein the slope of the sealing interface is configured to generate reactive forces from the hard seat normal to the sealing interface.

14. The subsurface safety valve of claim 1, further comprising a soft seat disposed adjacent the hard seat.

15. The subsurface safety valve of claim 14, wherein the flapper contacts the soft seat before contacting the hard seat when the flapper is moved from its open position to its closed position.

16. The subsurface safety valve of claim 14, wherein the soft seat is made from an elastomeric material.

17. The subsurface safety valve of claim 1, further comprising a soft seat concentrically disposed an outside perimeter of the hard seat.

18. The subsurface safety valve of claim 1, wherein the hard seat is fabricated from a metal alloy.

19. The subsurface safety valve of claim 1, further comprising an actuator mechanism for selectively opening the flapper.

20. The subsurface safety valve of claim 19, further comprising a pressure equalizing valve for permitting fluid to bleed through the flapper when the actuator mechanism is actuated, thereby equalizing any pressure differential across the flapper and enabling the flapper to open.

21. A curved flapper for a well bore safety valve, wherein the curved flapper is configured to pivot between an open position and a closed position, the curved flapper comprising:

a sealing surface for engaging a corresponding sealing surface on a seat disposed in the well bore safety valve to form a sealing interface having a slope that varies along the sealing interface such that reactive forces from the seat are normal to the sealing interface, thereby substantially reducing distortion between the curved flapper and the seat to inhibit the upward flow of fluids in a well bore when the curved flapper is in the closed position.

22. The subsurface safety valve of claim 21, wherein the sealing interface is configured to substantially prevent the curved flapper from bending toward the well bore safety valve.

23. The subsurface safety valve of claim 21, wherein the sealing interface is undulated and defines at least two raised portions and at least two lower portions, and wherein the slope of the sealing interface is about zero degree with respect to an x-axis near the at least two raised portions.

24. The subsurface safety valve of claim 23, wherein the raised portions and the lower portions are about 90 degrees apart.

25. The subsurface safety valve of claim 21, wherein the sealing interface is undulated and defines at least two raised portions and at least two lower portions, and wherein the slope of the sealing interface is between about −10 degrees to about −15 degrees with respect to an x-axis near the at least two lower portions.

26. The subsurface safety valve of claim 25, wherein the raised portions and the lower portions are about 90 degrees apart.

27. The subsurface safety valve of claim 21, wherein the sealing interface is undulated and defines at least two raised portions and at least two lower portions, wherein the slope of the sealing interface is about zero degree with respect to an x-axis near the at least two raised portions, and wherein the slope of the sealing interface is between about −10 degrees to about −15 degrees with respect to the x-axis near the at least two lower portions.

28. The subsurface safety valve of claim 27, wherein the raised portions and the lower portions are about 90 degrees apart.

29. A valve for controlling fluid flow in a well bore, comprising:

a tubular member having a longitudinal bore therethrough;

a curved flapper having a seating surface, the curved flapper configured to pivot against the tubular member between an open position and a closed position; and a seat positioned inside the tubular member, the seat defining a seating surface configured to receive the sealing surface to form a sealing interface having a slope that is about zero degree with respect to an x-axis near at least two raised portions, and wherein the slope of the sealing interface is between about −10 degrees to about −15 degrees with respect to the x-axis near at least two lower portions to substantially inhibit distortion between the curved flapper and the tubular member.

30. The valve of claim 29, wherein the slope of the sealing interface is configured to generate reactive forces from the seat normal to the sealing interface.

* * * * *